US006489930B2

(12) United States Patent
Teshirogi et al.

(10) Patent No.: US 6,489,930 B2
(45) Date of Patent: Dec. 3, 2002

(54) DIELECTRIC LEAKY-WAVE ANTENNA

(75) Inventors: Tasuku Teshirogi, Tokyo; Yuki Kawahara; Takashi Hidai, both of Atsugi; Aya Yamamoto, Kawasaki, all of (JP)

(73) Assignee: Anritsu Corporation, Tokyo (JP)

( * ) Notice: Subject to any disclaimer, the term of this patent is extended or adjusted under 35 U.S.C. 154(b) by 0 days.

(21) Appl. No.: 09/741,276

(22) Filed: Dec. 19, 2000

(65) Prior Publication Data

US 2001/0017603 A1 Aug. 30, 2001

(30) Foreign Application Priority Data

Feb. 29, 2000 (JP) ..... 2000-054487
Jul. 25, 2000 (JP) ..... 2000-224271

(51) Int. Cl.[7] ..... H01Q 13/00

(52) U.S. Cl. ..... 343/785; 343/770; 343/776; 333/238

(58) Field of Search ..... 343/700 MS, 753, 343/754, 767, 770, 771, 772, 776, 785, 786; 333/238, 239; H01Q 13/00

(56) References Cited

U.S. PATENT DOCUMENTS 3,721,988 A * 3/1973 Schwartz et al. ..... 343/756
3,860,934 A * 1/1975 Cheo et al. ..... 343/778
4,468,673 A * 8/1984 Stern et al. ..... 343/785
4,618,865 A 10/1986 Lamensdorf ..... 343/776
4,825,221 A 4/1989 Suzuki et al.
4,835,543 A 5/1989 Sequeira ..... 343/785
5,173,714 A 12/1992 Arimura et al.
5,266,961 A 11/1993 Milroy ..... 343/772
5,448,252 A * 9/1995 Ali et al. ..... 343/700 MS
6,166,693 A * 12/2000 Nalbandian et al. . 343/700 MS
6,317,095 B1 * 11/2001 Teshirogi et al. ..... 343/785

FOREIGN PATENT DOCUMENTS

DE 39 26 187 A1 4/1990
EP 0 896 380 A2 2/1999
WO WO 91/17586 11/1991

OTHER PUBLICATIONS

Technical Report of IEICE.A.pp. 99–114, RCS99–111; Oct. 1999; pp. 59–64.

M. Ghomi et al: "Antenne Plaquee A Onde De Fuite A Balayage Du Faisceau", Journees Nationales Microondes (JNM), Nice, France, Jun. 22–24, 1987, University of Nice, France; vol. 5, Jun. 22, 1987, pp. 271–273, XP000145002—Abstract, Introduction, Figures 1 and 2.

* cited by examiner

*Primary Examiner*—Tho G. Phan
(74) *Attorney, Agent, or Firm*—Frishauf, Holtz, Goodman & Chick, P.C.

(57) ABSTRACT

A dielectric slab is arranged on one surface of a ground plane to form a transmission guide for transmitting an electromagnetic wave along the surface from one end to the other end between the dielectric slab and the ground plane. A perturbation is loaded on the dielectric slab to leak the electromagnetic wave from the surface of the dielectric slab. A feed supplies an electromagnetic wave to one end of the transmission guide formed by the ground plane and dielectric slab. A dielectric layer is interposed between the ground plane and the dielectric slab, and has a lower permittivity than that of the dielectric slab.

21 Claims, 10 Drawing Sheets

DIELECTRIC LEAKY-WAVE ANTENNA

CROSS-REFERENCE TO RELATED APPLICATIONS

This application is based upon and claims the benefit of priority from the prior Japanese Patent Applications No. 2000-054487, filed Feb. 29, 2000; and No. 2000-224271, filed Jul. 25, 2000, the entire contents of which are incorporated herein by reference.

BACKGROUND OF THE INVENTION

The present invention relates to a dielectric leaky-wave antenna and, more particularly, to a dielectric leaky-wave antenna for leaking electromagnetic waves from an electromagnetic wave transmission guide formed by a ground plane and dielectric, in which the structure is simplified and a technique of increasing the efficiency is adopted.

BRIEF SUMMARY OF THE INVENTION

In recent years, demands have arisen for an antenna which can be used in the milliwave band for a radio LAN, a radar mounted on an automobile, or the like.

As the milliwave-band antenna, various antennas are proposed, including an antenna which leaks electromagnetic waves from a slot formed in a waveguide, and a so-called triplate antenna in which a coupling slot is formed in a slab and power is fed via a triplate line.

Of these antennas, the antenna using a waveguide is difficult to manufacture because of a three-dimensional structure partitioned by a metallic wall.

The triplate antenna has a large line loss though the line loss is smaller than that of a microstrip line. Further, unwanted waves generated by reflection of an element are transmitted through the triplate line, so the antenna efficiency is low.

To solve these problems, a parallel-plate slot array antenna is proposed in which a transmission guide equivalent to a waveguide is formed by upper and lower metallic surfaces of a printed board and through holes extending through the metallic surfaces (TECHNICAL REPORT OF IEICE.A. PP. 99–114, RCS99-111 (1999-10)).

However, the parallel-plate antenna in which a transmission guide equivalent to a waveguide is formed using through holes in a printed board is more complicated in structure than a dielectric leaky-wave antenna, and requires a high manufacturing cost for forming through holes.

Further, this antenna uses a uniform electromagnetic field, i.e., TEM mode in a section perpendicular to the propagation direction. Thus, strong currents equal in magnitude flow through upper and lower metallic plates to generate a conductor loss, which increases the loss.

A dielectric plate is actually inserted between parallel plates in order to shorten the waveguide wavelength and suppress the grating lobe, too. This also generates a dielectric loss to limit a decrease in loss.

As another type of antenna, a leaky-wave antenna is proposed in which a narrow radiation dielectric bar is arranged as a transmission line on a two-layered dielectric slab, the height of part of the dielectric bar is changed, and metallic strips are periodically laid out at a small-height portion (U.S. Pat. No. 4,835,543, "Dielectric slab antennas"). This antenna is a one-dimensional array antenna. To obtain a two-dimensional plane antenna important in practical use, a plurality of radiation dielectric bars must be aligned, which results in low mass productivity. In addition, a feed system for feeding power to these dielectric bars in phase is complicated.

Furthermore, an invention has been applied in which a dielectric slab having projections on a plate in the vertical direction is prepared, and the surface of the slab is metallized to form a continuous transverse stub, and the stub is used for an antenna (U.S. Pat. No. 5,266,961, "Continuous transverse stub element devices and methods of making same"). This antenna is a slot array antenna uniform in the transverse direction using a parallel-plate waveguide to which a dielectric is inserted. In general, a dielectric material such as alumina having a high frequency such as a milliwave and a low loss is difficult to process. The manufacture of a complicated dielectric slab having many projections is disadvantageous in cost.

For this reason, implementation of an antenna having a high antenna efficiency and simple structure is demanded.

It is an object of the present invention to provide a dielectric leaky-wave antenna for leaking electromagnetic waves from an electromagnetic wave transmission guide formed by a ground plane and dielectric, in which the structure is simplified and a technique of increasing the antenna efficiency is adopted to meet this demand.

To achieve the above object, according to the present invention, (1) there is provided a dielectric leaky-wave antenna comprising:

- a ground plane;
- a dielectric slab arranged on one surface of the ground plane to form a transmission guide for transmitting an electromagnetic wave along a surface from one end to the other end between the dielectric slab and the ground plane;
- a perturbation loaded on the dielectric slab to leak the electromagnetic wave from the surface of the dielectric slab;
- a feed for supplying the electromagnetic wave to one end of the transmission guide formed by the ground plane and the dielectric slab; and
- a dielectric layer which is interposed between the ground plane and the dielectric slab and has a lower permittivity than a permittivity of the dielectric slab.

According to the present invention, (2) there is provided a dielectric leaky-wave antenna defined in (1), characterized in that the dielectric layer includes a gas layer including air or a vacuum layer.

According to the present invention, (3) there is provided a dielectric leaky-wave antenna defined in (1), characterized in that the perturbation is formed from a metallic strip or slot perpendicular to an electromagnetic wave transmission direction of the transmission guide.

According to the present invention, (4) there is provided a dielectric leaky-wave antenna defined in (1), characterized in that the perturbation is formed from a metallic strip or slot having an angle of 45° with respect to an electromagnetic wave transmission direction of the transmission guide.

According to the present invention, (5) there is provided a dielectric leaky-wave antenna defined in (1), characterized in that the perturbation is formed from a pair of metallic strips or pair of slots which form an angle of 90° with each other, and is loaded on the dielectric slab so as to form an angle of 45° with respect to an electromagnetic wave transmission direction of the transmission guide by each metallic strip of the pair of metallic strips or each slot of the pair of slots.

According to the present invention, (6) there is provided a dielectric leaky-wave antenna defined in (1), characterized in that a pair of perturbations parallel-arranged at an interval almost ¼ a wavelength of the electromagnetic wave in the transmission guide in the electromagnetic wave transmission direction of the transmission guide are loaded at a predetermined interval in the electromagnetic wave transmission direction of the transmission guide.

According to the present invention, (7) there is provided a dielectric leaky-wave antenna defined in (6), characterized in that one of the pair of perturbations is formed on one surface of the dielectric slab, and the other is formed on an opposite surface of the dielectric slab.

According to the present invention, (8) there is provided a dielectric leaky-wave antenna defined in (6), characterized in that the pair of perturbations are formed on an upper surface of the dielectric slab.

According to the present invention, (9) there is provided a dielectric leaky-wave antenna defined in (1), characterized in that the feed is formed to radiate a cylindrical wave, and a wave-front conversion section for converting the cylindrical wave radiated by the feed into a plane wave and guiding the plane wave to the transmission guide is arranged at one end of the dielectric slab.

According to the present invention, (10) there is provided a dielectric leaky-wave antenna defined in (1), characterized in that the wave-front conversion section is formed by extending the dielectric slab toward the feed.

According to the present invention, (11) there is provided a dielectric leaky-wave antenna defined in (10), characterized in that a matching section for matching the feed and the wave-front conversion section and guiding the electromagnetic wave supplied by the feed to the wave-front conversion section is arranged at a distal end of the wave-front conversion section.

According to the present invention, (12) there is provided a dielectric leaky-wave antenna defined in (10), characterized in that the feed is formed to transmit an electromagnetic wave input from one end to one end of the dielectric slab along the ground plane and to radiate the electromagnetic wave from an aperture at the other end that is formed to surround an edge of the one end of the dielectric slab, and a matching section projecting toward the ground plane so as to decrease a gap between the feed and a surface of the wave-front conversion section stepwise or continuously toward the wave-front conversion section in order to match the feed and the wave-front conversion section is arranged in the aperture at the other end of the feed.

According to the present invention, (13) there is provided a dielectric leaky-wave antenna defined in (9), characterized in that the wave-front conversion section has a reflecting wall for converting a cylindrical wave into a plane wave and reflecting the plane wave, and is arranged to make one half of the reflecting wall face one end of the dielectric slab, and the feed is arranged on a side opposite to the dielectric slab via the ground plane while a radiation surface faces the other half of the reflecting wall of the wave-front conversion section so as to radiate an electromagnetic wave toward the other half.

According to the present invention, (14) there is provided a dielectric leaky-wave antenna defined in (13), characterized in that a matching section for matching the wave-front conversion section and the transmission guide of the dielectric slab is arranged at one end of the dielectric slab.

According to the present invention, (15) there is provided a dielectric leaky-wave antenna defined in (11), characterized in that the matching section is tapered to decrease a thickness toward an electro-magnetic wave input side.

According to the present invention, (16) there is provided a dielectric leaky-wave antenna defined in (14), characterized in that the matching section is tapered to decrease a thickness toward an electro-magnetic wave input side.

According to the present invention, (17) there is provided a dielectric leaky-wave antenna defined in (11), characterized in that the matching section is formed from a dielectric having a permittivity different from a permittivity of the dielectric slab.

According to the present invention, (18) there is provided a dielectric leaky-wave antenna defined in (14), characterized in that the matching section is formed from a dielectric having a permittivity different from a permittivity of the dielectric slab.

According to the present invention, (19) there is provided a dielectric leaky-wave antenna defined in (13), characterized in that the wave-front conversion section is formed to transmit an electromagnetic wave reflected by the reflecting wall to one end of the dielectric slab along the ground plane and to radiate the electromagnetic wave from an aperture at the other end that is formed to surround an edge of the one end of the dielectric slab, and a matching section projecting toward the ground plane so as to decrease a gap between the feed and a surface of the dielectric slab stepwise or continuously toward the dielectric slab in order to match the wave-front conversion section and the transmission guide of the dielectric slab is arranged in the aperture at the other end of the wave-front conversion section.

According to the present invention, (20) there is provided a dielectric leaky-wave antenna defined in (9), characterized in that the feed has a plurality of radiators having different radiation center positions, and the wave-front conversion section converts a cylindrical wave radiated by each radiator into a plane wave whose wave front is inclined at an angle corresponding to the radiation center position of the each radiator, and supplies the plane wave to the transmission guide.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
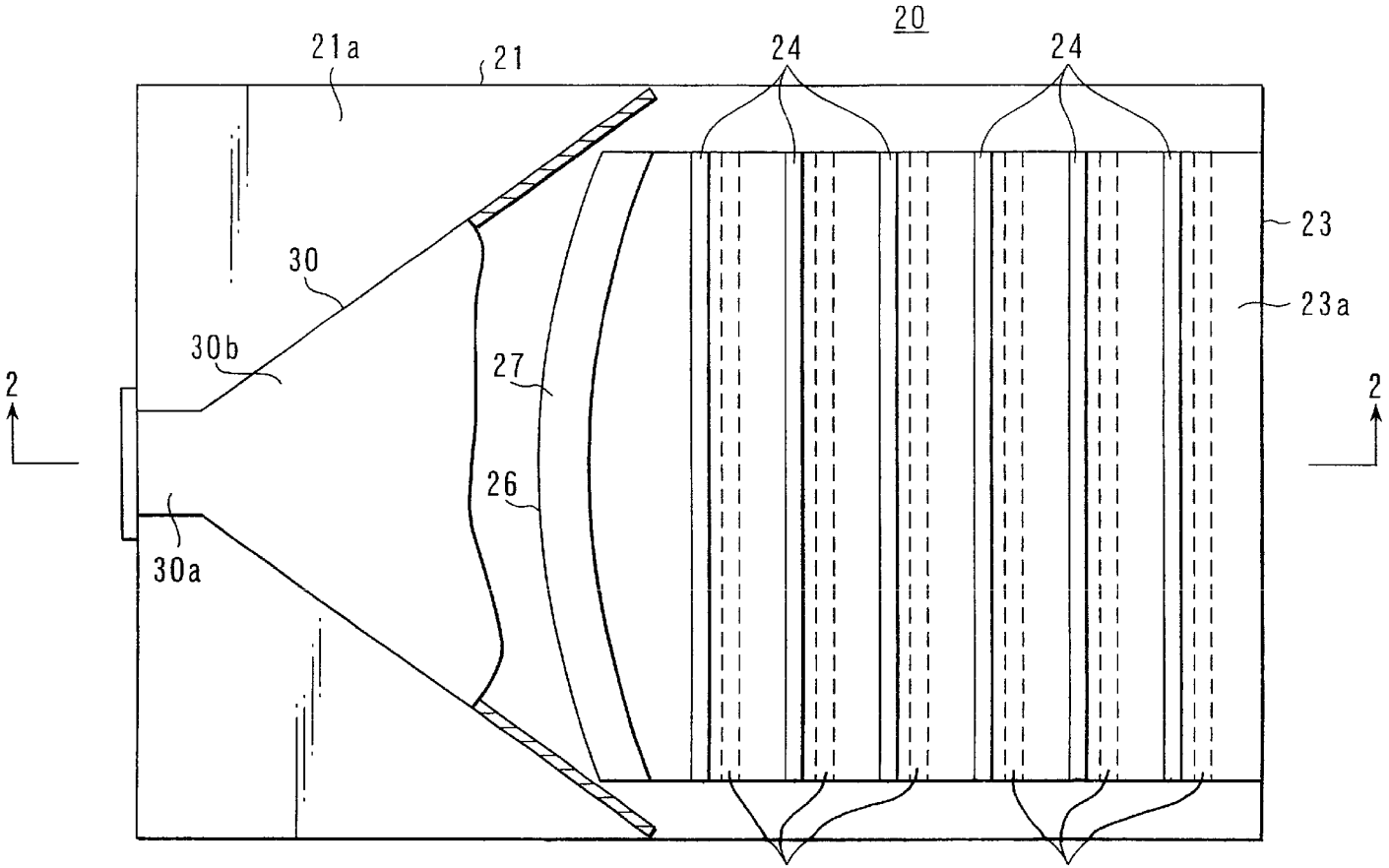
FIG. 1 is a front view for explaining the arrangement of a dielectric leaky-wave antenna according to an embodiment of the present invention.

Reference will now be made in detail to the presently preferred embodiments of the invention as illustrated in the accompanying drawings, in which like reference numerals designate like or corresponding parts.

Preferred embodiments of the present invention will be described below with reference to several views of the accompanying drawing.

Figure 2:
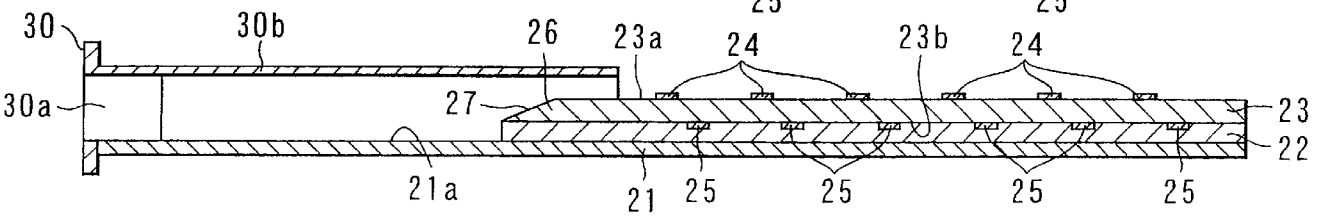
FIG. 2 is a sectional view taken along the line 2—2 in FIG. 1.

FIGS. 1 and 2 show the structure of a dielectric leaky-wave antenna 20 according to an embodiment of the present invention.

The dielectric leaky-wave antenna 20 has a ground plane 21 formed from a flat metallic plate.

A first dielectric slab 22 constituting the dielectric layer of this embodiment is fixed to an upper surface 21*a* of the ground plane 21 such that the lower surface of the first dielectric slab 22 tightly contacts the upper surface 21*a*.

The first dielectric slab 22 is formed from a dielectric having a low permittivity, e.g., a slab which is made of PTFE (fluoroplastic) having a relative permittivity Er=2.1 and is about 0.2 mm in thickness. The first dielectric slab 22 has an almost rectangular outer shape with one convex end.

A second dielectric slab 23 which forms a transmission guide for transmitting electromagnetic waves between the second dielectric slab 23 and the ground plane 21 is fixed to the upper surface of the first dielectric slab 22 such that the lower surface of the second dielectric slab 23 tightly contacts the upper surface of the first dielectric slab 22.

The second dielectric slab 23 is formed from a dielectric having a high permittivity in order to transmit an electromagnetic wave, e.g., a slab which is made of alumina having a relative permittivity Er=9.7 and is about 0.8 mm in thickness. The second dielectric slab 23 has the same outer shape as that of the first dielectric slab 22, and overlaps the first dielectric slab 22 so as to match their outer shapes.

The permittivity of the second dielectric slab 23 is much higher than that of air on the upper surface and that of the first dielectric slab 22 on the lower surface.

Electromagnetic waves fed from one end of the second dielectric slab 23 travel toward the other end concentratedly through the second dielectric slab 23 having a high permittivity.

The electromagnetic waves uniformly propagate in the direction of width of the second dielectric slab 23.

For this reason, the rectangular portion of the second dielectric slab 23 except for the curved portion extending to one end forms one wide transmission guide in which small-width transmission guides equal in length for transmitting electromagnetic waves from one end to the other end are successively aligned in the direction of width.

A plurality of (6 in FIGS. 1 and 2) metallic strips 24 having a predetermined width S are parallel-arranged as perturbations of the embodiment on the upper surface of the rectangular portion (transmission guide) of the second dielectric slab 23 at a predetermined interval d with a length equal to the width of the second dielectric slab 23.

These metallic strips 24 are formed by patterning. In practice, the thickness of the metallic strip 24 is on the $\mu$m order and small to a negligible degree in comparison with that of the second dielectric slab 23.

The metallic strips 24 are, however, illustrated to be thick in FIGS. 1 and 2 for easy understanding.

If the metallic strips 24 are parallel-arranged on the dielectric slab at a predetermined interval in this way, space harmonics are generated in electromagnetic waves traveling through the slab, and a given one of the electromagnetic waves leaks from the slab surface.

The radiation direction (angle with reference to an axis perpendicular to the slab) of the leaky wave is generally given by $$\phi_n = \sin^{31\ 1}\{(\beta/k_o)+n(\lambda_o/d)\}$$

where $\lambda_o$ is the guide wavelength, $\beta$ is the propagation constant of a dielectric line, $k_o$ is a propagation constant in a free space, and n is an integer. In general, the interval d is selected to set only a leaky wave having n=−1 as a radiation wave.

The radiation amount is determined by the width S of the metallic strip.

If, therefore, electromagnetic waves are supplied from one end in the direction of length of the slab (direction perpendicular to the metallic strip 24) to the second dielectric slab 23, a leaky wave having an intensity determined by the width S of the metallic strip is radiated in a direction determined by the interval d of the metallic strip 24.

In a leaky-wave antenna of this type in which a dielectric slab tightly contacts a ground plane for leaking an electromagnetic wave, the conductor loss by an RF current flowing through the ground plane increases to decrease the antenna efficiency.

However, in the dielectric leaky-wave antenna 20, a dielectric layer (in this case, the first dielectric slab 22) having a low permittivity is interposed between the ground plane 21 and the second dielectric slab 23, as described above. The RF current flowing through the ground plane 21 can decrease to greatly suppress a decrease in antenna efficiency caused by the conductor loss.

The results of an actual sample exhibit a high efficiency of 58% (the results of the latest sample exhibit more than 65%).

Metallic strips 25 which form pairs of perturbations with the upper-surface-side metallic strips 24 and have the same length and width S as those of the metallic strips 24 are parallel-arranged on the lower surface of the second dielectric slab 23 at the same interval d as that of the metallic strips 24.

Each metallic strip 25 is shifted from the upper-surface-side metallic strip 24 by a distance $\delta=\lambda g/4$ ($\lambda g$ is a guide wavelength) in the electromagnetic wave propagation direction.

By arranging pairs of perturbations having the same shape at an interval of $\lambda g/4$ in the electro-magnetic wave propagation direction, reflection of electromagnetic waves traveling through the second dielectric slab 23 can be suppressed.

Figure 3A:
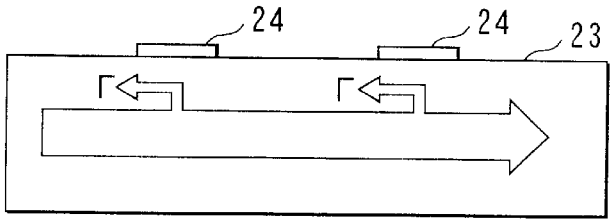
FIGS. 3A and 3B are front views for explaining the operation of the main part of the dielectric leaky-wave antenna according to the embodiment of the present invention.

More specifically, when no metallic strips 25 are arranged, electromagnetic waves traveling through the second dielectric slab 23 are reflected at the metallic strip 24, as shown in FIG. 3A. A reflected wave $\Gamma$ greatly varies the electric field in the dielectric line, as represented by curve B in FIG. 4.

Figure 3B:
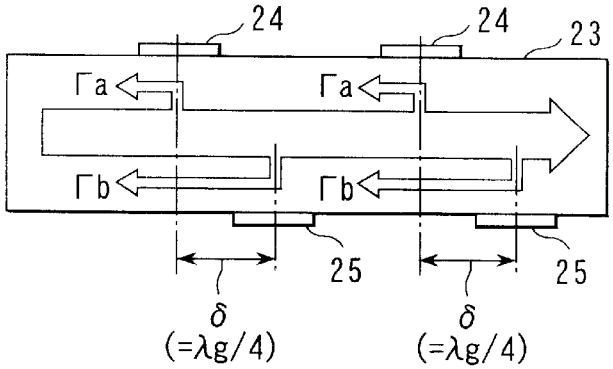

To the contrary, if the metallic strips 25 are arranged on the lower surface with a shift of $\delta=\lambda g/4$, the difference in propagation length between a wave $\Gamma a$ reflected by the upper-surface-side metallic strip 24 and a wave $\Gamma b$ reflected by the lower-surface-side metallic strip 25 becomes $\lambda g/2$, as shown in FIG. 3B. The reflected waves $\Gamma a$ and $\Gamma b$ attain opposite phases to cancel each other.

Figure 4:
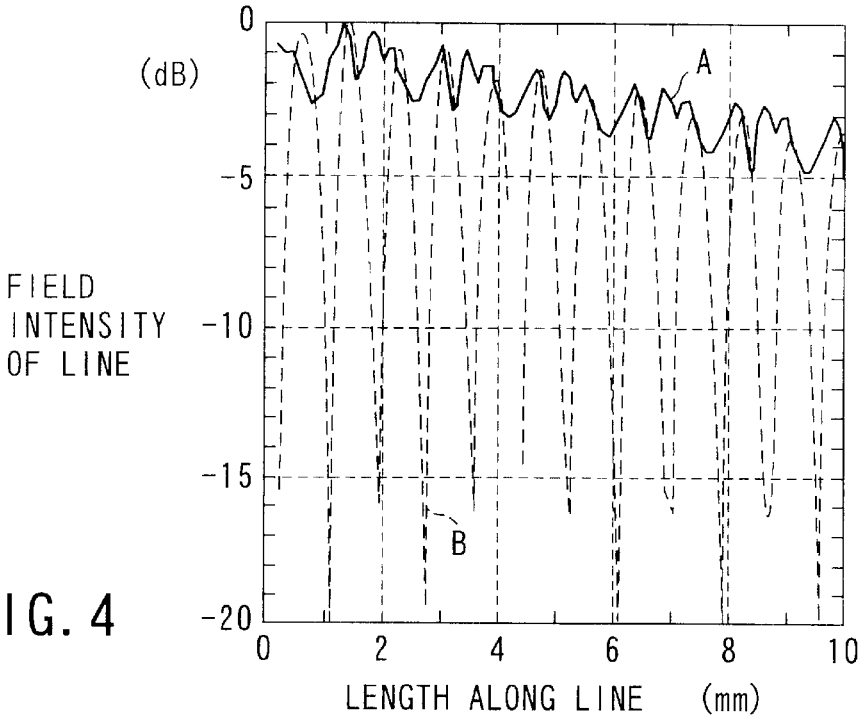
FIG. 4 is a graph for explaining the characteristics of the dielectric leaky-wave antenna according to the embodiment of the present invention.

As a result, an electric field distribution which hardly varies, as represented by curve A in FIG. 4, can be obtained.

FIG. 4 is a graph showing the change characteristic of the electric field in the dielectric line as a function of the distance in the propagation direction when an air layer 0.1 mm in thickness is used as a dielectric layer instead of the first dielectric slab 22.

In general, if metallic strips are formed by patterning only on one surface of a thin dielectric slab, the slab warps and may break or crack in the assembly owing to the warpage.

However, forming the metallic strips 24 and 25 on the two surfaces of the second dielectric slab 23 greatly reduces the warpage of the slab itself, which can significantly reduce generation of breaks and cracks.

A portion of the second dielectric slab 23 which extends to curve at one end is a wave-front conversion section 26 for converting cylindrical waves radiated by a feed 30 (to be described later) into plane waves, and inputting the plane waves to one end of the transmission guide (rectangular portion) of the second dielectric slab 23 in phase.

In this embodiment, the wave-front conversion section 26 is formed by extending the second dielectric slab 23 to one end so as to form a dielectric lens, and converts cylindrical waves having a radiation center at the focal position into plane waves parallel in the direction of width of the second dielectric slab 23.

A matching section 27 for attaining matching between the wave-front conversion section 26 and the feed 30 (to be described later) is formed at the edge of the distal end of the wave-front conversion section 26.

The matching section 27 is tapered to decrease the height toward the feed 30. with a simple structure, the matching section 27 can efficiently guide electro-magnetic waves from the feed 30 to the wave-front conversion section 26.

The feed 30 is an electromagnetic horn type feed made up of a waveguide 30*a* and horn 30*b*, and radiates electromagnetic waves input from the waveguide 30*a* to the wave-front conversion section 26.

The feed 30 employs an H-plane sectoral horn or E-plane sectoral horn in which the radiation aperture plane suffices to have a small height.

An H-plane sectoral horn type feed radiates TM-waves having no magnetic field H component in the radiation direction.

An E-plane sectoral horn type feed radiates TE-waves having no electric field E component in the radiation direction.

In the H- or E-plane sectoral horn, the wave front (equiphase front) of radiated electromagnetic waves is a cylindrical front as far as the horn 30*b* is not so long.

As described above, cylindrical waves radiated by the feed 30 are converted into plane waves by the wave-front conversion section 26, and the plane waves are incident in phase on one end of the transmission guide formed by the second dielectric slab 23.

Resultantly, leaky waves in phase in the direction of width are radiated from the surface of the second dielectric slab 23.

More specifically, when the dielectric leaky-wave antenna is used upright so as to set the feed 30 to the top or bottom side, electromagnetic waves of vertical polarization having components in a plane (vertical plane) defined by an electromagnetic wave propagation direction in the second dielectric slab 23 and a direction perpendicular to the slab are radiated.

In the dielectric leaky-wave antenna 20 of this embodiment, the dielectric layer (first dielectric slab 22) having a permittivity lower than that of the second dielectric slab 23 is interposed between the ground plane 21 and the second dielectric slab 23 which forms a transmission guide for transmitting electromagnetic waves between the second dielectric slab 23 and the ground plane 21. The conductor loss by a current flowing through the ground plane 21 can be decreased to significantly increase the radiation efficiency.

In addition, the metallic strips 25 are arranged on the lower surface of the second dielectric slab 23 with a shift of $\delta=\lambda g/4$ in the electromagnetic wave propagation direction with respect to the metallic strips 24 arranged as perturbations on the upper surface of the second dielectric slab 23 so as to pair the metallic strips 24 and 25. This arrangement can cancel reflected components of electromagnetic waves traveling through the second dielectric slab 23.

Accordingly, the dielectric leaky-wave antenna 20 of this embodiment can obtain design radiation characteristics, and can easily realize a complicated radiation pattern.

In the dielectric leaky-wave antenna 20 described above, the first dielectric slab 22 serving as a dielectric layer is fixed to the lower surface of the second dielectric slab 23 so as to tightly contact each other.

Strictly speaking, the metallic strips 25 project from the lower surface of the second dielectric slab 23.

Hence, although the metallic strips 25 are very thin, the first dielectric slab 22 and second dielectric slab 23 do not completely tightly contact each other, and a small air layer is formed at a position where no metallic strips 25 are arranged.

Assuming that no metallic strips 25 are arranged on the lower surface of the second dielectric slab 23, an air layer may be formed between the first dielectric slab 22 and the second dielectric slab 23 due to slight warpage of the slabs or the like.

When the influence of the thin air layer on radiation characteristics cannot be ignored, an air layer (or a vacuum layer, or a gas layer other than an air layer) is used as a dielectric layer in place of the first dielectric slab 22.

For a gas layer other than an air layer, the permittivity must be lower than that of the second dielectric slab 23.

Figure 5:
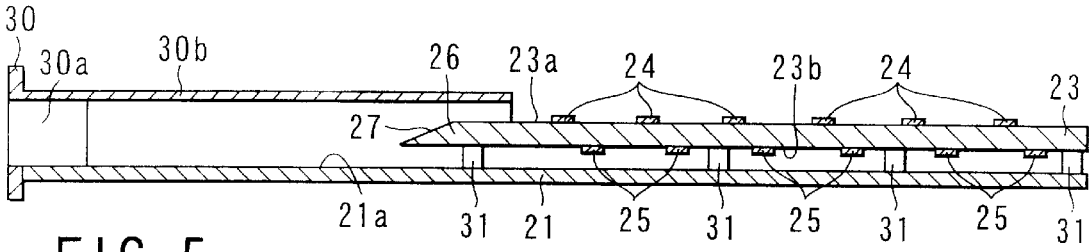
FIG. 5 is a sectional view when the dielectric layer of the dielectric leaky-wave antenna according to the embodiment of the present invention is an air layer.

For example, when the dielectric layer is formed by an air layer, the second dielectric slab 23 is supported on the ground plane 21 via spacers 31 to form an air layer 32 between the ground plane 21 and the second dielectric slab 23, as shown in FIG. 5.

The spacers 31 in use are small and low in permittivity so as not to influence radiation of leaky waves.

When the dielectric layer is formed by a gas layer other than an air layer, the gas is sealed between the ground plane 21 and the second dielectric slab 23.

To form a vacuum layer, gas between the ground plane 21 and the second dielectric slab 23 is exhausted.

Forming an air layer, another gas layer, or a vacuum layer as a dielectric layer can prevent formation of another layer between the ground plane 21 and the second dielectric slab 23. An antenna having characteristics closer to design values can be implemented.

In the dielectric leaky-wave antenna 20 described above, the metallic strips 24 having a length equal to the width of the second dielectric slab 23 are arranged as perturbations perpendicularly to the electromagnetic wave propagation direction of the transmission guide.

Figure 6:
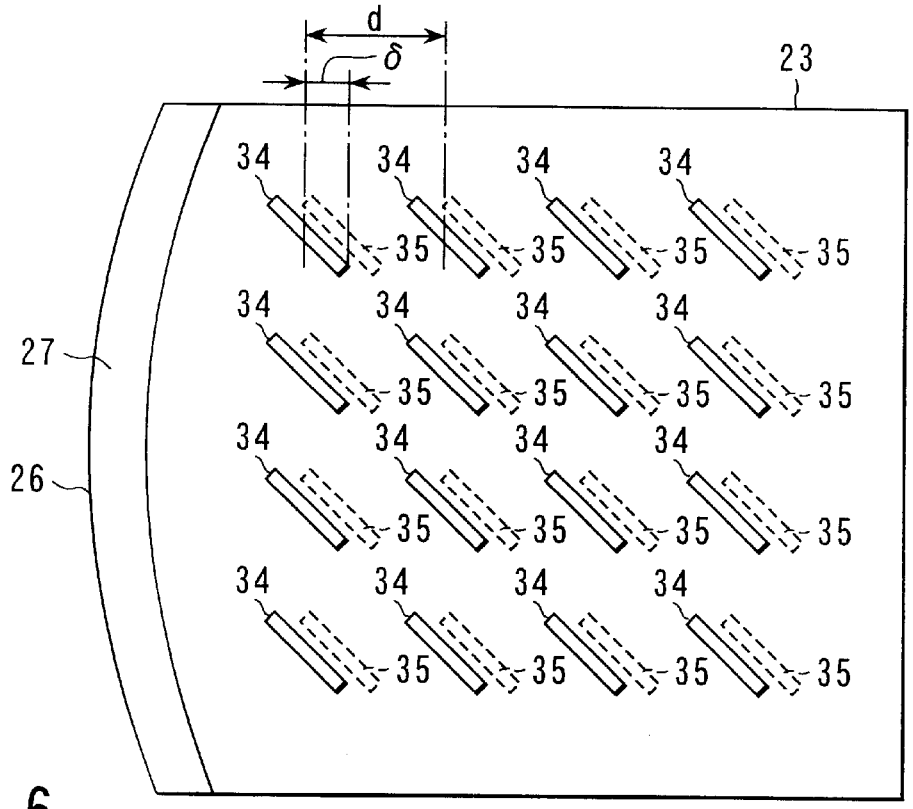
FIG. 6 is a plan view showing a modification of the perturbation of the dielectric leaky-wave antenna according to the embodiment of the present invention.

Instead, if metallic strips 34 having an angle of 45° with respect to the electromagnetic wave propagation direction of the transmission guide are laid out in a matrix at a predetermined interval, as shown in FIG. 6, electromagnetic waves of 45° inclined polarization can be easily radiated.

That is, if the length of each metallic strip 34 is selected to constitute a dipole so as to resonate, an RF current flows in the direction of length.

For this reason, electromagnetic waves having an angle of 45° with respect to the electromagnetic wave propagation direction of the transmission guide, i.e., electromagnetic waves of 45° inclined linear polarization leak.

An antenna for radiating electromagnetic waves of 45° inclined linear polarization is inevitable as the antenna of a radar mounted on an automobile.

When a front automobile is searched by a radar device to control the traveling, radar waves from an automobile traveling on an opposite lane act as interference waves.

Even in this case, if the above-mentioned 45° inclined polarization antenna is used, electromagnetic waves from the oncoming automobile are perpendicular to the polarization direction of the antenna of the self automobile to eliminate any interference.

Note that when the metallic strips 34 having an angle of 45° are arranged on the upper surface of the second dielectric slab 23, metallic strips 35 equal in length and width are parallel-arranged on the lower surface with a shift of $\delta=\lambda g/4$ in the transmission direction. Similar to the above arrangement, this arrangement can suppress generation of reflected waves in the transmission guide.

Figure 7:
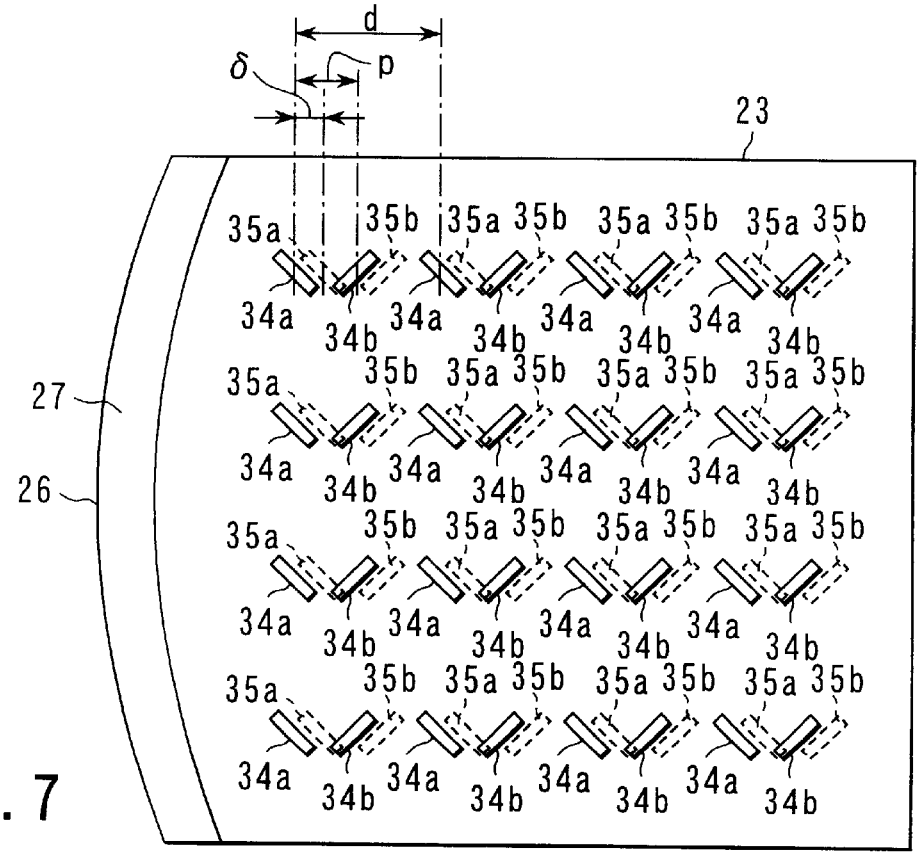
FIG. 7 is a plan view showing another modification of the perturbation of the dielectric leaky-wave antenna according to the embodiment of the present invention.

Alternatively, as shown in FIG. 7, pairs of metallic strips 34*a* and 34*b* laid out to form an angle of 90° may be arranged at the interval d in the electromagnetic wave transmission direction of the transmission guide and a predetermined interval in the direction of width of the transmission guide such that each pair of metallic strips 34*a* and 34*b* have an angle of 45° in the electromagnetic wave transmission direction of the transmission guide.

In this case, electromagnetic waves of horizontal polarization or circular polarization can be easily radiated depending on an interval P between a pair of metallic strips 34*a* and 34*b*.

Figure 8A:
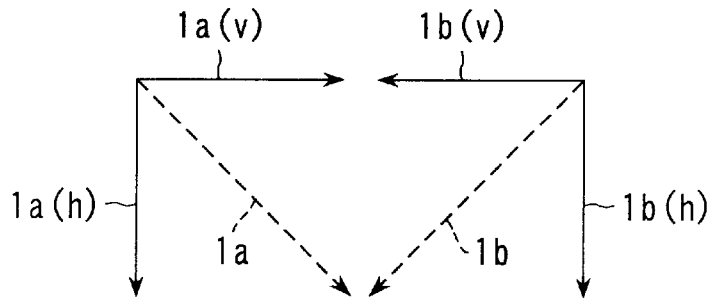
FIGS. 8A and 8B are views for explaining the operation of the perturbation in FIG. 7.
Figure 8B:
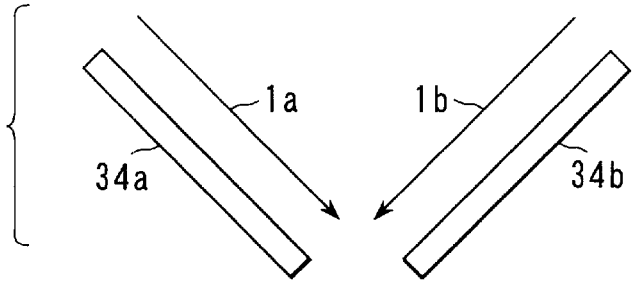

For example, when a pair of metallic strips 34*a* and 34*b* are arranged at an interval of $P=\lambda g/2$, RF currents Ia and Ib in the directions of lengths of the metallic strips 34*a* and 34*b* flow symmetrically, as shown in FIGS. 8A and 8B.

In this case, the horizontal components (up-to-down components in FIGS. 8A and 8B) Ia(h) and Ib(h) of the RF currents Ia and Ib are in phase with each other and added, whereas vertical components Ia(v) and Ib(v) are in opposite phases and cancel each other. As a result, electromagnetic waves of horizontal polarization are radiated.

Although not shown, when a pair of metallic strips 34*a* and 34*b* are arranged at an interval of $P=\lambda/4$, the directions of currents flowing through a pair of metallic strips 34*a* and 34*b* are spatially perpendicular to each other, and the phase difference is 90°. Electromagnetic waves of circular polarization whose polarization plane rotates are radiated.

When the pairs of metallic strips 34*a* and 34*b* are arranged on the upper surface of the second dielectric slab 23, pairs of metallic strips 35*a* and 35*b* equal in length and width are arranged on the lower surface with a shift of $\delta=\lambda g/4$ in the transmission direction. Similar to the above arrangement, this arrangement can suppress generation of reflected waves in the transmission guide.

This embodiment uses the metallic strips 24, 25, 34, and 35 as perturbations, but can also use slots instead of these strips.

Figure 9:
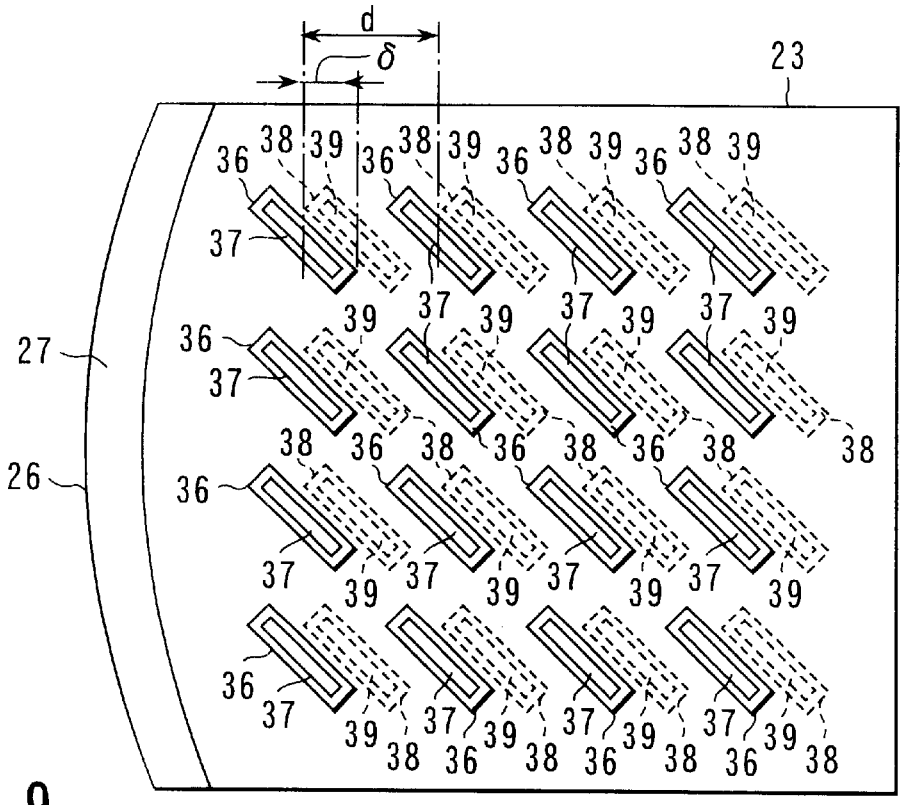
FIG. 9 is a plan view showing still another modification of the perturbation of the dielectric leaky-wave antenna according to the embodiment of the present invention.

For example, if slots 37 are formed in metallic frame plates 36 at an angel of 45°, as shown in FIG. 9, in place of the metallic strips 34 and 35, electro-magnetic waves of 45° inclined linear polarization can be radiated.

Note that when the slots 37 are formed in the upper surface of the second dielectric slab 23, identical slots 39 are formed in the lower surface with a shift of $\delta=\lambda g/4$ in the transmission direction. Similar to the above arrangement, this arrangement can suppress generation of reflected waves (reference numeral 38 denote metallic frame plates).

Although not shown, if slots are used instead of the metallic strips 24 and 25, electromagnetic waves of vertical linear polarization can be radiated.

If slots are used instead of a pair of metallic strips 34*a* and 34*b* and a pair of metallic strips 35*a* and 35*b*, electromagnetic waves of horizontal linear polarization or circular polarization can be radiated.

In the above description, one of a pair of perturbations formed from metallic strips or slots is formed on or in one surface of the second dielectric slab 23, and the other is formed on or in the opposite surface of the second dielectric slab 23. Alternatively, a pair of perturbations may be formed on the upper surface of the second dielectric slab 23.

Figure 10:
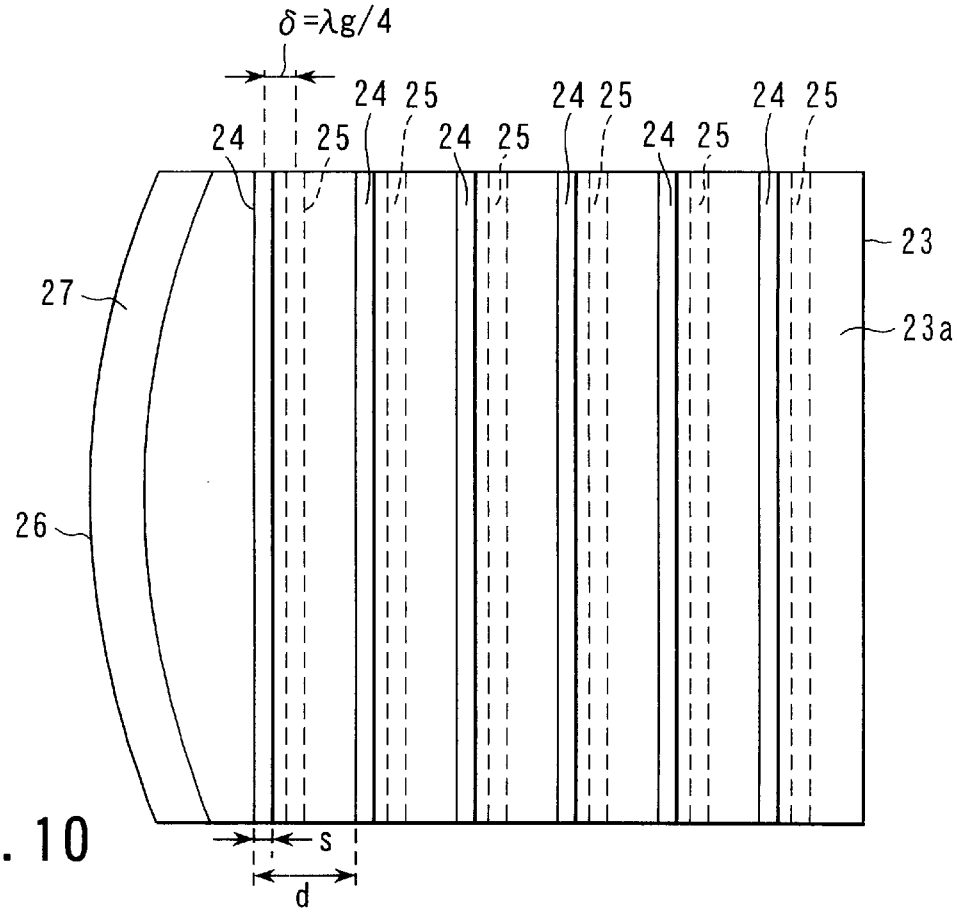
FIG. 10 is a plan view showing still another modification of the perturbation of the dielectric leaky-wave antenna according to the embodiment of the present invention.

For example, as shown in FIG. 10, metallic strips 24 and 25 which have the same length as the width of the dielectric slab 23, are perpendicular to the electromagnetic wave transmission direction of the transmission guide, and are parallel-arranged at an interval $\delta$ almost ¼ the guide wavelength $\lambda g$ are laid out as pairs of perturbations at a predetermined interval d in the electromagnetic wave transmission direction of the transmission guide.

Figure 11:
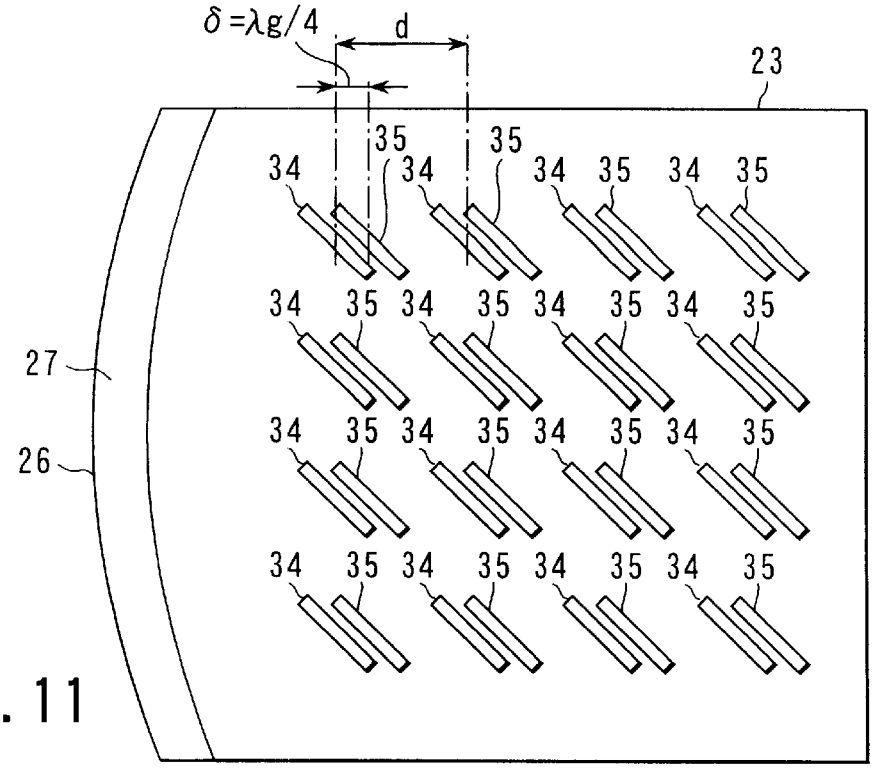
FIG. 11 is a plan view showing still another modification of the perturbation of the dielectric leaky-wave antenna according to the embodiment of the present invention.

Alternatively, as shown in FIG. 11, metallic strips 34 and 35 which form an angle of 45° with respect to the electromagnetic wave transmission direction of the transmission guide and are parallel-arranged at an interval almost ¼ the guide wavelength are laid out as pairs of perturbations at a predetermined interval d in the electromagnetic wave transmission direction of the transmission guide.

Figure 12:
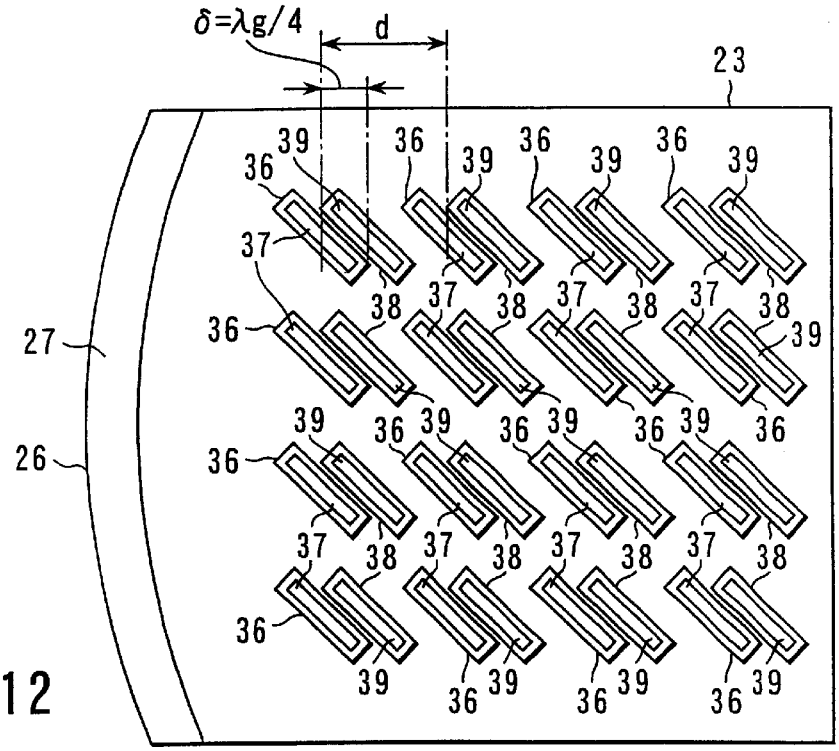
FIG. 12 is a plan view showing still another modification of the perturbation of the dielectric leaky-wave antenna according to the embodiment of the present invention.

Alternatively, as shown in FIG. 12, slots 37 and 39 (reference numeral 38 denote metallic frame plates) which form an angle of 45° with respect to the electromagnetic wave transmission direction of the transmission guide and are parallel-arranged at an interval almost ¼ the guide wavelength are laid out as pairs of perturbations at a predetermined interval d in the electromagnetic wave transmission direction of the transmission guide.

With these arrangements, a component of an electromagnetic wave reflected by one of metallic strips or slots serving as a pair of perturbations, and a component of an electromagnetic wave reflected by the other can be canceled to prevent disturbance of the electrical field in the transmission guide caused by reflected waves.

In addition, the first dielectric slab (dielectric layer) 22 can tightly contact the second dielectric slab 23 to obtain characteristics very close to design ones.

When pairs of perturbations are formed on the surface of the second dielectric slab 23 in this manner, the length, width, or interval d of each perturbation is set to give desired characteristics to a synthesized wave of an electromagnetic wave leaking from one of the perturbations and an electromagnetic wave leaking from the other.

In the dielectric leaky-wave antenna 20, the wave-front conversion section 26 is constituted by a dielectric lens formed by extending one end of the second dielectric slab 23.

Figure 13:
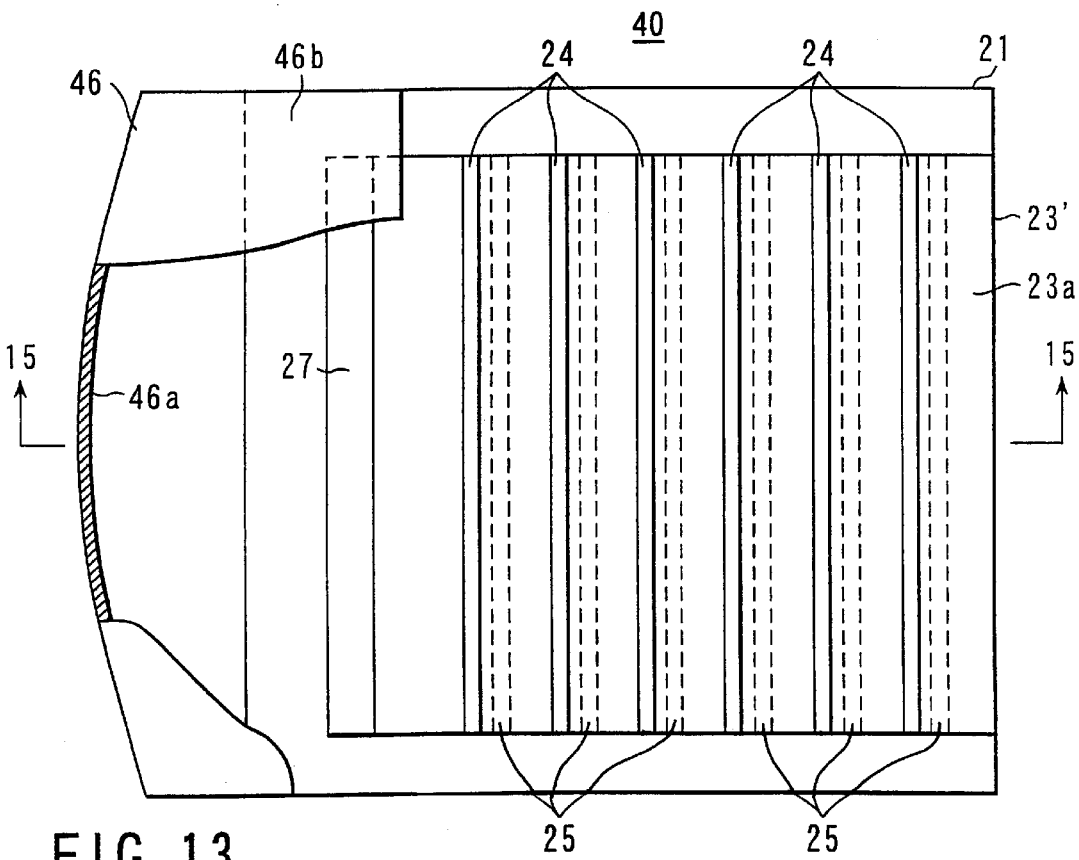
FIG. 13 is a front view for explaining an arrangement when a reflector type wave-front conversion section is used in a dielectric leaky-wave antenna according to another embodiment of the present invention.
Figure 14:
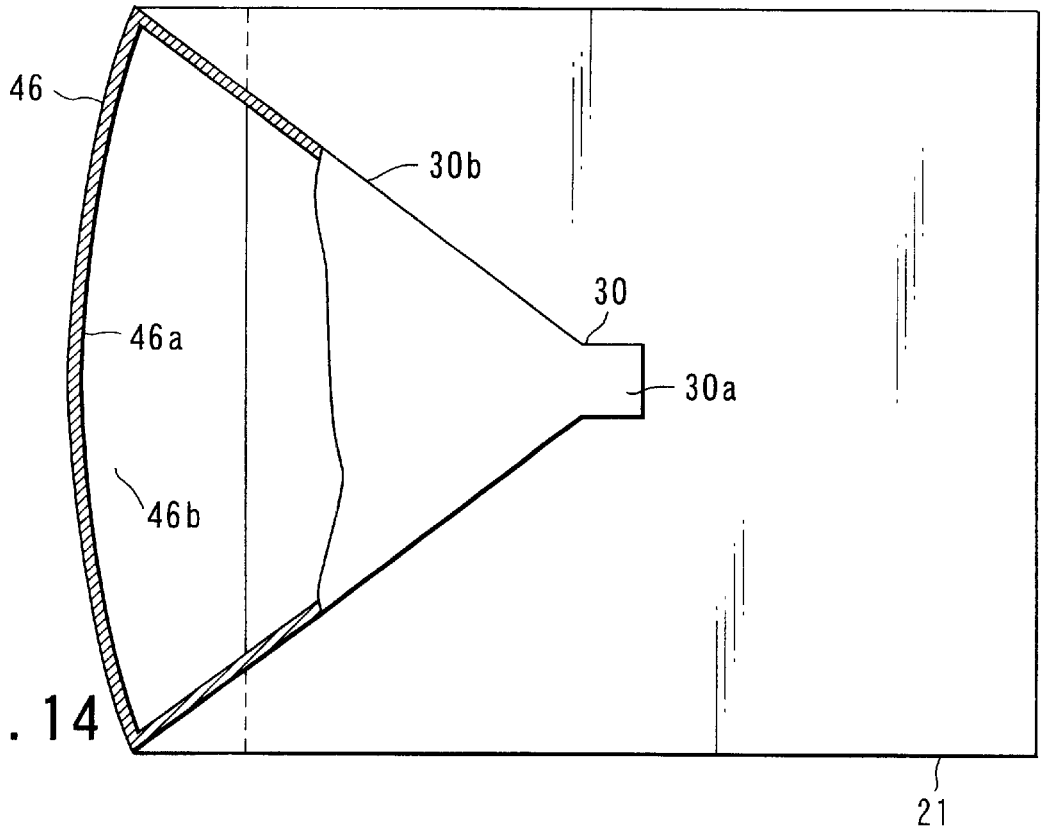
FIG. 14 is a rear view for explaining the arrangement when the reflector type wave-front conversion section is used in the dielectric leaky-wave antenna according to the embodiment shown in FIG. 13.
Figure 15:
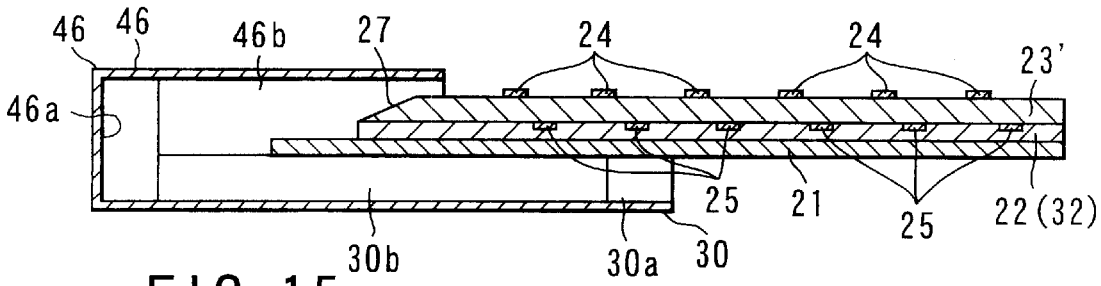
FIG. 15 is a sectional view taken along the line 15—15 in FIG. 13.

Instead of this, a parabolic reflector type wave-front conversion section 46 may be adopted, like a dielectric leaky-wave antenna 40 shown in FIGS. 13 to 15 as another embodiment.

The wave-front conversion section 46 has a reflecting wall 46*a* for reflecting cylindrical waves and converting them into plane waves, and a guide 46*b* for guiding the reflected plane waves to one end of a second dielectric slab 23'.

The wave-front conversion section 46 is attached such that the upper half of the reflecting wall 46*a* faces one end of the second dielectric slab 23', and the lower half covers the aperture plane of a horn 30*b* of an electromagnetic horn type feed 30 attached to the lower surface of a ground plane 21.

Cylindrical waves radiated by the feed 30 are reflected by the reflecting wall 46*a* of the wave-front conversion section 46, and converted into plane waves, which are input in phase to the transmission guide of the second dielectric slab 23'.

In the dielectric leaky-wave antenna 40, the feed 30 is arranged on the back surface to reflect electro-magnetic waves, so that the entire antenna length can be shortened.

The dielectric leaky-wave antenna 40 does not require any dielectric lens, so that one end of the second dielectric slab 23' can be linearly shaped (outer shape can be formed into a rectangular).

Along with this, a matching section 27 is also linearly formed, which further facilitates processing of the slab.

Also in the dielectric leaky-wave antenna 40, a first dielectric slab 22 may be formed from an air layer 32 (or another gas layer) using spacers 31, as shown in FIG. 5.

As for a pair of perturbations, not only metallic strips 24 and 25, but also metallic strips 34 and 35 pairs of metallic strips 34*a*, 34*b*, 35*a*, and 35*b*, or slots 37 and 39 can be adopted.

In the dielectric leaky-wave antenna 20 or 40 described above, the matching section 27 is tapered to de crease the height of the surface side toward the electromagnetic wave input side.

Figure 16:
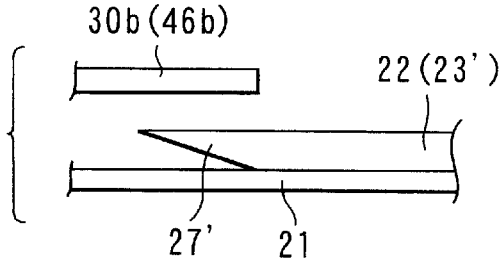
FIG. 16 is a sectional view showing a modification of the matching section of the dielectric leaky-wave antenna according to the embodiment shown in FIG. 13.

Alternatively, the matching section 27 may be tapered to increase the height of a surface on the ground plane 21 side toward the electromagnetic wave input side, like a matching section 27' shown in FIG. 16.

By forming the tapered portion so as to increase the height from the ground plane side, the matching state becomes better, and the transmission loss decreases.

For example, the matching section 27' is used as a result of analyzing the transmission loss when the height of the aperture portion from the ground plane 21 at the horn 30*b* of the feed 30 and the guide 46*b* of the wave-front conversion section 46 is 1.8 mm, the thickness of an alumina second dielectric slab 23 or 23' is 0.64 mm, the tapering length is 8.6 mm, and the thickness of the tapered distal end is 0.2 mm.

In this case, it is confirmed that the transmission loss is smaller by almost 0.8 dB within the frequency range of 60 to 90 GHz, and the variation width is much smaller than in the use of the matching section 27.

When the matching section 27 or 27' is used, the distal end of the dielectric slab must be tapered.

However, when the slab may break or crack owing to tapering, a matching dielectric having a permittivity different from that of the second dielectric slab 23 or 23' may be attached to the distal end instead of tapering, thereby attaining matching.

Figure 17A:
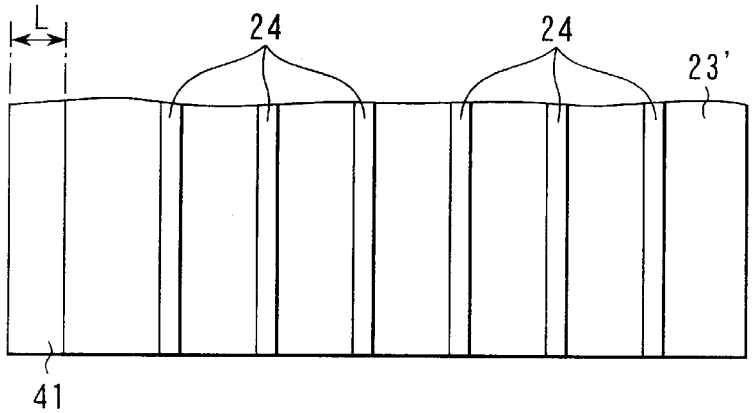
FIGS. 17A and 17B are a plan view and sectional view, respectively, showing another modification of the matching section of the dielectric leaky-wave antenna according to the embodiment shown in FIG. 13.
Figure 17B:
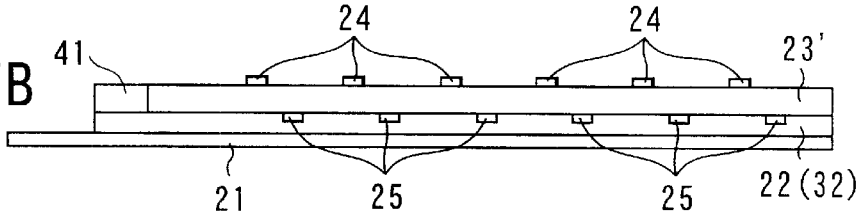

For example, as shown in FIGS. 17A and 17B, a matching dielectric 41 having a relative permittivity E1 and a width L1 is attached to the distal end of the second dielectric slab 23' to attain matching.

In this case, the length L of the matching dielectric 41 is set equal to ¼ the guide wavelength $\lambda g$. At the same time, letting Er be the relative permittivity of the second dielectric slab 23' (or second dielectric slab 23), and E0 be the relative permittivity (1 for air in general) in the guide 46*b* of the wave-front conversion section 46 (or in the horn 30*b* of the feed 30), the relative permittivity E1 is desirably set to establish $$E1=(Er\cdot Eo)^{1/2}$$

In the dielectric leaky-wave antenna 20 or 40 of the embodiment, the matching section 27 or 27' is arranged at one end of the dielectric slab 23 or 23'.

Alternatively, the matching section can be arranged on the wave-front conversion section 46 or feed 30 side for supplying electromagnetic waves to one end of the dielectric slab 23 or 23'.

Figure 18:
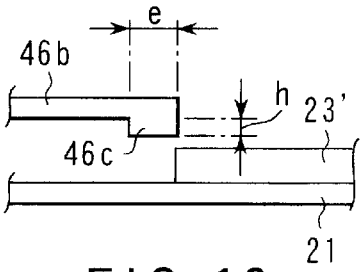
FIG. 18 is a sectional view showing still another modification of the matching section of the dielectric leaky-wave antenna according to the embodiment shown in FIG. 13.

For example, as shown in FIG. 18, a matching section 46*c* projecting by a length h toward the ground plane 21 so as to decrease the gap between the matching section 46*c* and the upper surface of the dielectric slab 23' stepwise toward the dielectric slab is formed continuously in the direction of width at a predetermined depth e inside the aperture of the guide 46*b* of the wave-front conversion section 46 which is open to surround the edge of one end of the dielectric slab 23'.

In this case, the projecting length h and depth e of the matching section 46*c* are set such that, letting Z1 be the impedance in the guide 46*b* and Z2 be the impedance of the transmission guide of the dielectric slab 23', an impedance Z of a transmission guide formed between the matching section 46*c* and the ground plane 21 satisfies $$Z=(Z1\cdot Z2)^{1/2}$$

Since the matching section 46*c* is arranged inside the aperture of the guide 46*b*, matching between the wave-front conversion section 46 and the transmission guide of the dielectric slab 23' can be attained without tapering the dielectric slab or using a dielectric having a different permittivity, as described above.

Figure 19:
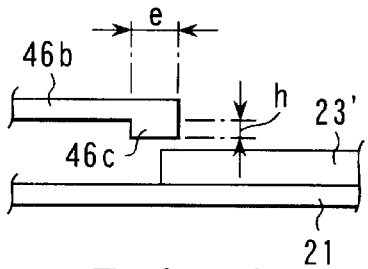
FIG. 19 is a sectional view showing still another modification of the matching section of the dielectric leaky-wave antenna according to the embodiment shown in FIG. 13.

In FIG. 18, the position of the distal end of the matching section 46*c* coincides with that of the edge of one end of the dielectric slab 23'. Alternatively, as shown in FIG. 19, the matching section 46*c* may be arranged to overlap one end of the dielectric slab 23'.

This matching method can also be used for matching between the horn 30*b* of the feed 30 and the wave-front conversion section 26 formed by extending one end of the dielectric slab 23.

In this case, a matching section projecting toward the ground plane 21 so as to decrease the gap between the feed 30 and the surface of the wave-front conversion section 26 stepwise is formed continuously in the direction of width at a predetermined depth inside the aperture of the horn 30*b* which is open to surround the edge of one end of the dielectric slab 23.

Since the distal end of the wave-front conversion section 26 is curved, as described above, the matching section is also curved in conformity with the edge of the distal end of the wave-front conversion section 26.

The matching section 46*c* projects toward the ground plane 21 so as to decrease the gap between the matching section 46*c* and the upper surface of the dielectric slab 23' stepwise.

Figure 20:
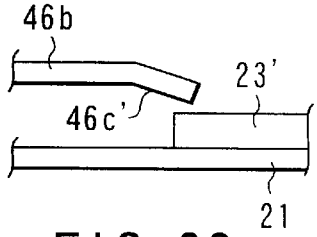
FIG. 20 is a sectional view showing still another modification of the matching section of the dielectric leaky-wave antenna according to the embodiment-shown in FIG. 13.

Alternatively, as shown in FIG. 20, a matching section 46*c'* may project toward the ground plane 21 so as to decrease the gap between the matching section 46*c* and the surface of the dielectric slab 23' stepwise.

This matching method can also be used for matching between the horn 30*b* of the feed 30 and the wave-front conversion section 26 formed by extending one end of the dielectric slab 23 as described above.

In the dielectric leaky-wave antenna 20 or 40, the radiation direction (direction of a main beam) is one direction.

However, the dielectric leaky-wave antenna 20 or 40 can be used as a multibeam antenna by changing the wave-front conversion section 26 or 46 and the feed 30.

Figure 21:
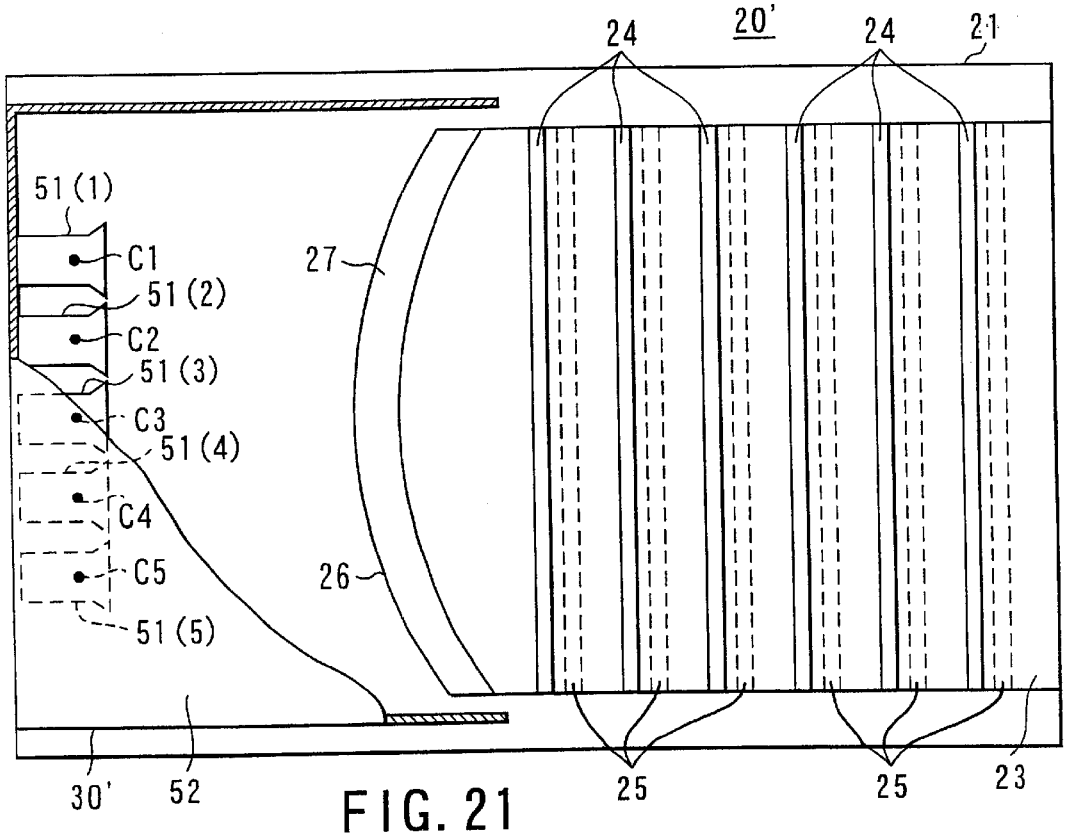
FIG. 21 is a plan view showing a modification of the feed and wave-front conversion section of the dielectric leaky-wave antenna according to the embodiment shown in FIG. 13.

For example, when the dielectric leaky-wave antenna 20 is arranged as a multibeam antenna, a dual focus type wave-front conversion section 26' (dielectric lens) is adopted, and a feed 30' is constituted by a plurality of, e.g., five waveguide type radiators 51(1) to 51(5) and a cover 52, like a dielectric leaky-wave antenna 20' shown in FIG. 21.

Radiation centers C1 to C5 of the radiators are located on or near the focal plane of the wave-front conversion section 26'.

Figure 22:
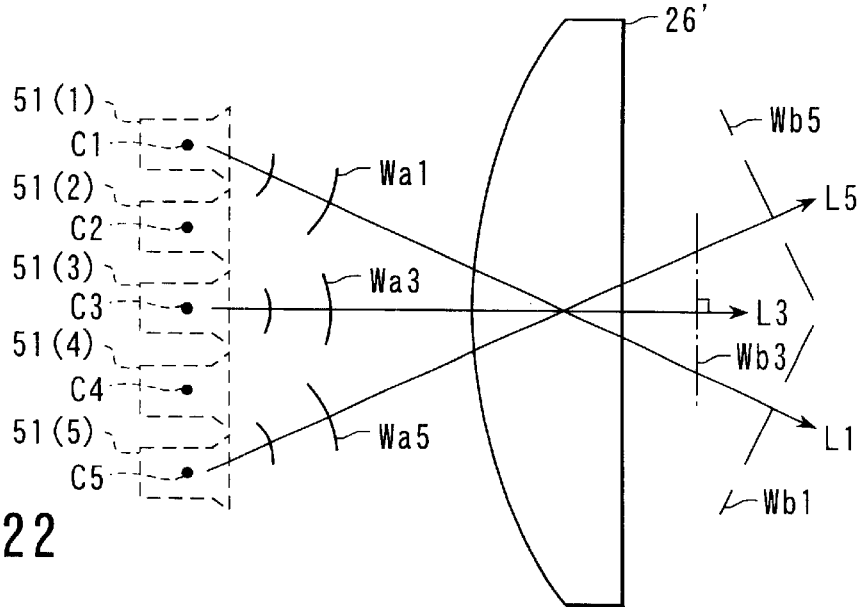
FIG. 22 is a plan view for explaining the operations of the feed and wave-front conversion section in FIG. 21.

In the dielectric leaky-wave antenna 20' having this arrangement, as shown in FIG. 22, e.g., a cylindrical wave Wa3 radiated by the central radiator 51(3) is converted into a plane wave Wb3 perpendicular to a line L3 (in this case, a straight line parallel to the transmission guide of the second dielectric slab 23) passing from the radiation center C3 through the center of the wave-front conversion section 26'.

Similarly to the above-described arrangement, electromagnetic waves are input in phase to the transmission guide of the second dielectric slab 23 to radiate beams along a plane which is perpendicular to the slab surface and includes the propagation direction of the transmission guide.

For example, a cylindrical wave Wa1 radiated by the radiator 51(1) at the upper end is converted into a plane wave Wb1 perpendicular to a line L1 passing from the radiation center C1 through the center of the wave-front conversion section 26', and the plane wave Wb1 is input to the transmission guide of the second dielectric slab 23.

As a result, electromagnetic waves are input to the transmission guide of the second dielectric slab 23 with a larger phase delay as the electromagnetic waves are separated farther from the upper side toward the lower side in FIG. 22. Along with this, the phases of leaking electromagnetic waves delay more greatly as the electromagnetic waves are separated farther from the upper side toward the lower side (in FIG. 22). Thus, the beam direction is inclined to the phase delay direction (lower side in FIG. 22).

To the contrary, a cylindrical wave Wa5 radiated by the radiator 51(5) at the lower end is converted into a plane wave Wb5 perpendicular to a line L5 passing from the radiation center C5 through the center of the wave-front conversion section 26', and the plane wave Wb5 is input to the transmission guide of the second dielectric slab 23.

Then, electromagnetic waves are input to the transmission guide of the second dielectric slab 23 with a larger phase delay as the electromagnetic waves are separated farther from the lower side toward the upper side in FIG. 22. Along with this, the phases of leaking electromagnetic waves delay more greatly as the electromagnetic waves are separated farther from the lower side toward the upper side (in FIG. 22). Consequently, the beam direction is inclined to the phase delay direction (upper side in FIG. 22).

In this fashion, the beam direction changes depending on the radiators 51(1) to 51(5). If electromagnetic waves are selectively supplied to the radiators 51(1) to 51(5), electromagnetic waves can be radiated in a direction corresponding to the position of each radiator, and the beam direction can be switched.

This multibeam arrangement can also be applied to the dielectric leaky-wave antenna 40.

Figure 23:
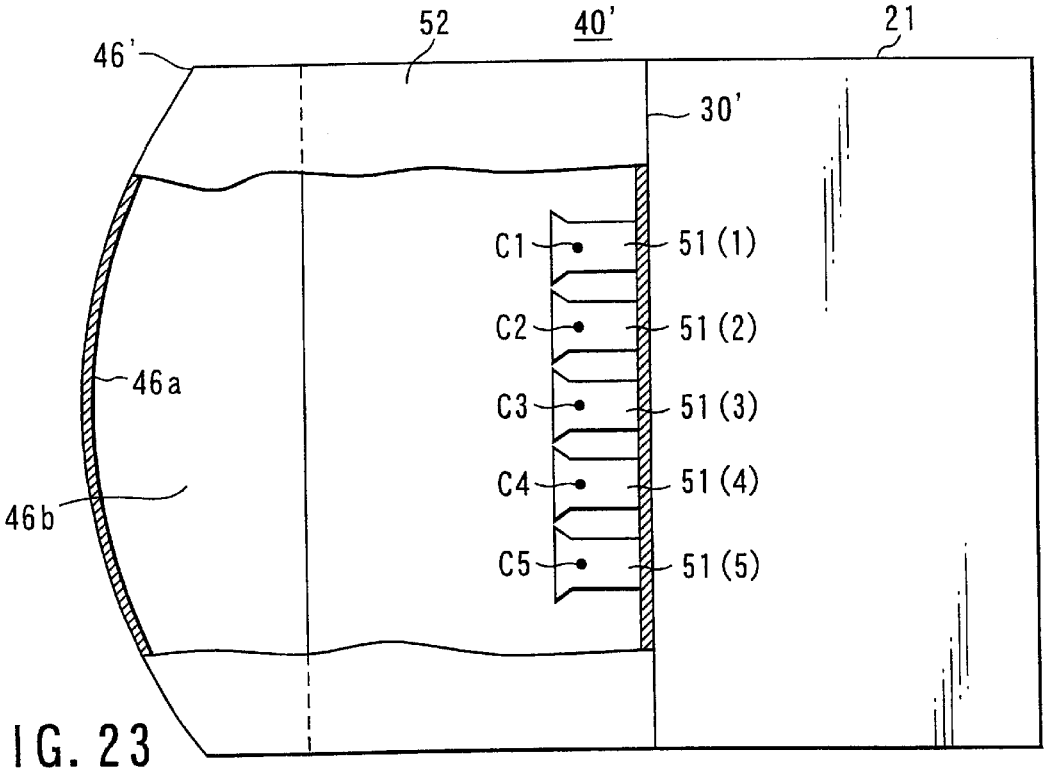
FIG. 23 is a view showing a modification of the feed and wave-front conversion section of the dielectric leaky-wave antenna according to still another embodiment of the present invention.

In this case, like a dielectric leaky-wave antenna 40', in FIG. 23, the reflecting wall 46*a* of the wave-front conversion section 46 is formed into a parabolic shape, and the radiation centers C1 to C5 of a plurality of radiators 51(1) to 51(5) of the feed 30' are located on or near the focal plane.

In the dielectric leaky-wave antenna 20' or 40', the tapered matching section 27 is formed at the distal end of the wave-front conversion section 26' or the distal end of the dielectric slab 23'.

However, the matching section 27' or the matching dielectric 41 having a different permittivity may be used in place of the matching section 27.

As for the dielectric leaky-wave antenna 20', a matching section identical to the matching section 46*c* arranged in the aperture of the guide 46*b* may be formed to project from the inside of the aperture of the cover 52 toward the ground plane 21.

As a pair of perturbations, not only the metallic strips 24 and 25, but also the metallic strips 34 and 35, the slots 37 and 39, a pair of metallic strips 34*a* and 34*b*, or a pair of slots (not shown) can be employed.

In this multibeam antenna, electromagnetic waves must be selectively supplied to the radiators 51(1) to 51(5).

Figure 24:
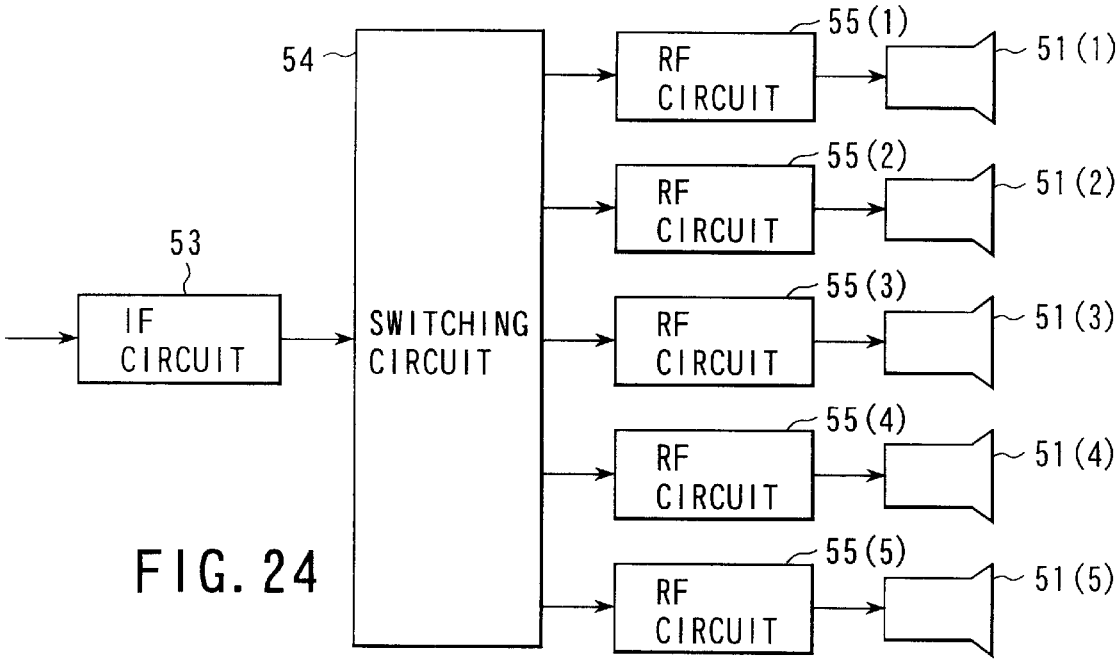
FIG. 24 is a block diagram showing an example of a feed circuit applied to the present invention.
Figure 25:
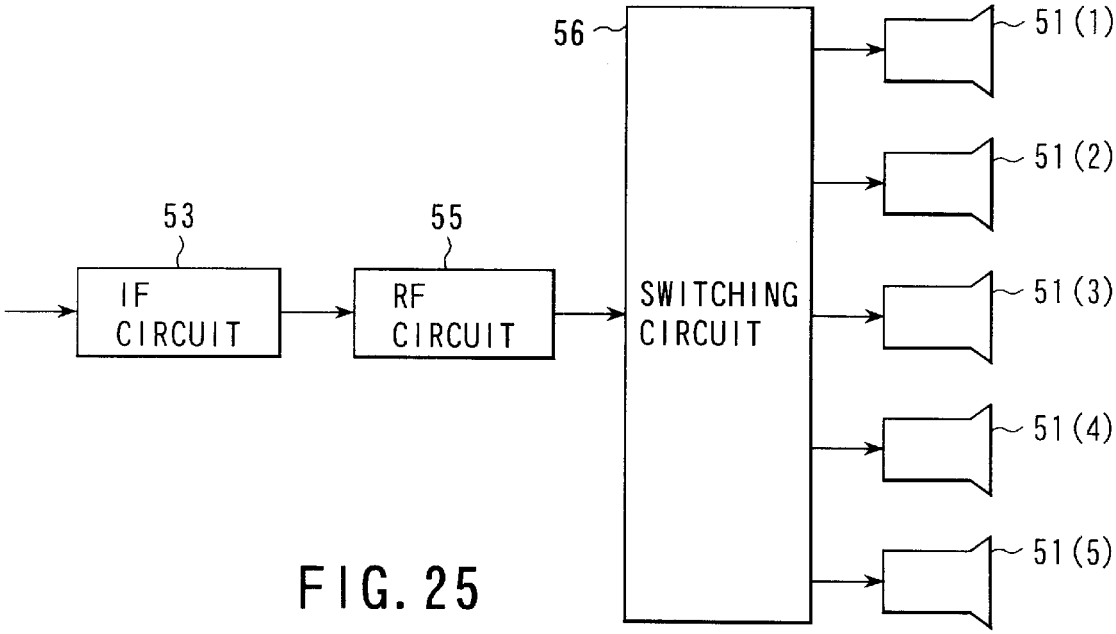
FIG. 25 is a block diagram showing another example of the feed circuit applied to the present invention.

FIGS. 24 and 25 show examples of a feed circuit.

In the feed circuit shown in FIG. 24, a switching circuit 54 selectively inputs an IF signal output from an IF circuit 53 to any one of a plurality of RF circuits (including frequency conversion circuits) 51(1) to 51(5) arranged in correspondence with the respective radiators 51(1) to 51(5).

In the feed circuit shown in FIG. 25, an RF circuit 55 converts an IF signal output from the IF circuit 53 into an RF signal, and a switching circuit 56 selectively inputs the RF signal to any one of the radiators 51(1) to 51(5).

In terms of the performance and mounting, the feed circuit in FIG. 24 for switching an IF signal is more advantageous.

In terms of the circuit scale, the feed circuit in FIG. 25 which requires only one RF circuit is more advantageous.

Either of the circuits to be used is determined in accordance with the intended use.

Although not shown, each radiator 51 is coupled to the RF circuit 55 or switching circuit 56 via a coupling slot, coupling probe, or the like.

As described above, in (1) a dielectric leaky-wave antenna of the present invention which comprises a ground plane, a dielectric slab arranged on one surface of the ground plane to form a transmission guide for transmitting electromagnetic waves along the surface from one end to the other end between the dielectric slab and the ground plane, a perturbation loaded on the dielectric slab to leak the electromagnetic waves from the surface of the dielectric slab, and a feed for supplying the electromagnetic waves to one end of the transmission guide formed by the ground plane and the dielectric slab, a dielectric layer having a lower permittivity than that of the second dielectric slab is interposed between the ground plane and the dielectric slab.

According to the dielectric leaky-wave antenna (1) of the present invention, the current loss of the ground plane can be greatly decreased. A milliwave antenna having a very high radiation efficiency with a simple arrangement can be implemented.

According to a dielectric leaky-wave antenna (2) of the present invention, the dielectric layer includes a gas layer including air or a vacuum layer in the dielectric leaky-wave antenna (1). Only the dielectric layer can be interposed between the ground plane and the dielectric slab, and characteristics closer to design values can be obtained.

According to a dielectric leaky-wave antenna (3) of the present invention, the perturbation is formed from a metallic strip or slot perpendicular to the electromagnetic wave transmission direction of the transmission guide in the dielectric leaky-wave antenna (1). Electromagnetic waves of linear polarization can be easily radiated.

According to a dielectric leaky-wave antenna (4) of the present invention, the perturbation is formed from a metallic strip or slot having an angle of 45° with respect to the electromagnetic wave transmission direction of the transmission guide in the dielectric leaky-wave antenna (1). Electromagnetic waves of 45° inclined linear polarization can be easily radiated.

According to a dielectric leaky-wave antenna (5) of the present invention, in the dielectric leaky-wave antenna (1), the perturbation is formed from a pair of metallic strips or pair of slots which form an angle of 90° with each other, and is loaded on the dielectric slab so as to form an angle of 45° with respect to the electromagnetic wave transmission direction of the transmission guide by each metallic strip of the pair of metallic strips or each slot of the pair of slots.

According to the dielectric leaky-wave antenna (5) of the present invention, electromagnetic waves of linear polarization or circular polarization can be easily radiated by selecting the interval between a pair of metallic strips or slots.

According to a dielectric leaky-wave antenna (6) of the present invention, a pair of perturbations parallel-arranged at an interval almost ¼ the wavelength of the electromagnetic wave in the transmission guide in the electromagnetic wave transmission direction of the transmission guide are loaded at a predetermined interval in the electromagnetic wave transmission direction of the transmission guide in the dielectric leaky-wave antenna (1).

According to the dielectric leaky-wave antenna (6) of the present invention, waves reflected by the perturbation in the transmission guide can be canceled, and disturbance of characteristics by the reflection can be prevented.

According to a dielectric leaky-wave antenna (7) of the present invention, one of the pair of perturbations is formed on one surface of the dielectric slab, and the other is formed on the opposite surface of the dielectric slab in the dielectric leaky-wave antenna (6). With this structure, warpage of the dielectric slab can be prevented, and generation of breaks and cracks of the slab by the warpage can be prevented According to a dielectric leaky-wave antenna (8) of the present invention, the pair of perturbations are formed on an upper surface of the dielectric slab in the dielectric leaky-wave antenna (6). The dielectric layer can tightly contact the dielectric slab, and characteristics closer to design ones can be obtained.

According to a dielectric leaky-wave antenna (9) of the present invention, in the dielectric leaky-wave antenna (1), the feed is formed to radiate cylindrical waves, and a wave-front conversion section for converting the cylindrical waves radiated by the feed into plane waves and guiding the plane waves to the transmission guide is arranged at one end of the dielectric slab.

According to the dielectric leaky-wave antenna (9) of the present invention, electromagnetic waves in phase can be supplied to the transmission guide formed by the dielectric slab.

According to a dielectric leaky-wave antenna (10) of the present invention, the wave-front conversion section is formed by extending the dielectric slab toward the feed in the dielectric leaky-wave antenna (9). The arrangement is simple, wave-front-converted electromagnetic waves can be directly guided to the transmission guide, and the efficiency is high.

According to a dielectric leaky-wave antenna (11) of the present invention, a matching section for matching the feed and the wave-front conversion section and guiding the electromagnetic waves supplied by the feed to the wave-front conversion section is arranged at the distal end of the wave-front conversion section in the dielectric leaky-wave antenna (1). Electromagnetic waves from the feed can be efficiently guided to the wave-front conversion section.

According to a dielectric leaky-wave antenna (12) of the present invention, in the dielectric leaky-wave antenna (10), the feed is formed to transmit electro-magnetic waves input from one end to one end of the dielectric slab along the ground plane and to radiate the electromagnetic waves from an aperture at the other end that is formed to surround an edge of the one end of the dielectric slab, and a matching section projecting toward the ground plane so as to decrease a gap between the feed and a surface of the wave-front conversion section stepwise or continuously toward the wave-front conversion section in order to match the feed. and the wave-front conversion section is arranged in the aperture at the other end of the feed.

According to the dielectric leaky-wave antenna (12) of the present invention, the feed and wave-front conversion section can be easily matched without tapering the dielectric or using a dielectric having a different permittivity.

According to a dielectric leaky-wave antenna (13) of the present invention, in the dielectric leaky-wave antenna (9), the wave-front conversion section has a reflecting wall for converting cylindrical waves into plane waves and reflecting the plane waves, and is arranged to make one half of the reflecting wall face one end of the dielectric slab, and the feed is arranged on a side opposite to the dielectric slab via the ground plane while the radiation surface faces the other half of the reflecting wall of the wave-front conversion section so as to radiate electromagnetic waves toward the other half. The entire antenna length can be shortened.

According to a dielectric leaky-wave antenna (14) of the present invention, a matching section for matching the wave-front conversion section and the transmission guide of the dielectric slab is arranged at one end of the dielectric slab in the dielectric leaky-wave antenna (13). Electromagnetic waves can be efficiently guided from the wave-front conversion section to the dielectric slab.

According to a dielectric leaky-wave antenna (15) of the present invention, the matching section is tapered to decrease the thickness toward the electro-magnetic wave input side in the dielectric leaky-wave antenna (11). Electromagnetic waves can be efficiently guided with a simple arrangement.

According to a dielectric leaky-wave antenna (16) of the present invention, the matching section is tapered to decrease the thickness toward the electro-magnetic wave input side in the dielectric leaky-wave antenna (14). Electromagnetic waves can be efficiently guided with a simple arrangement.

According to a dielectric leaky-wave antenna (17) of the present invention, the matching section is formed from a dielectric having a permittivity different from that of the dielectric slab in the dielectric leaky-wave antenna (11). The dielectric slab can be prevented from breaking and cracking.

According to a dielectric leaky-wave antenna (18) of the present invention, the matching section is formed from a dielectric having a permittivity different from that of the dielectric slab in the dielectric leaky-wave antenna (14). The dielectric slab can be prevented from breaking and cracking.

According to a dielectric leaky-wave antenna (19) of the present invention, in the dielectric leaky-wave antenna (13), the wave-front conversion section is formed to transmit electromagnetic waves reflected by the reflecting wall to one end of the dielectric slab along the ground plane and to radiate the electro-magnetic waves from an aperture at the other end that is formed to surround the edge of the one end of the dielectric slab, and a matching section projecting toward the ground plane so as to decrease the gap between the feed and the surface of the dielectric slab stepwise or continuously toward the dielectric slab in order to match the wave-front conversion section and the transmission guide of the dielectric slab is arranged in the aperture at the other end of the wave-front conversion section.

According to the dielectric leaky-wave antenna (19) of the present invention, the wave-front conversion section and the transmission guide of the dielectric slab can be easily matched without tapering the dielectric or using a dielectric having a different permittivity.

According to a dielectric leaky-wave antenna (20) of the present invention, in the dielectric leaky-wave antenna (9), the feed has a plurality of radiators having different radiation center positions, and the wave-front conversion section converts cylindrical waves radiated by each radiator into plane waves whose wave front is inclined at an angle corresponding to the radiation center position of the each radiator, and supplies the plane waves to the transmission guide.

As has been described in detail above, the present invention can provide a dielectric leaky-wave antenna for leaking electromagnetic waves from an electro-magnetic wave transmission guide formed by a ground plane and dielectric, in which the structure is simplified and a technique of increasing the antenna efficiency is adopted to meet the conventional demand.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A dielectric leaky-wave antenna comprising:

a ground plane;

a dielectric slab arranged on one surface of said ground plane to form a transmission guide for transmitting an electromagnetic wave along a surface from one end to the other end between said dielectric slab and said ground plane;

a plurality of perturbations arranged on said dielectric slab at regular intervals in a transmission direction of the electromagnetic wave for leaking the electromagnetic wave from said dielectric slab;

a feed for supplying the electromagnetic wave to one end of the transmission guide formed by said ground plane and said dielectric slab over a distance equal to an entire width of the transmission guide in a direction perpendicular to the transmission direction; and a dielectric layer which is interposed between said ground plane and said dielectric slab and has a lower permittivity than a permittivity of said dielectric slab;

wherein said ground plane comprises a flat metallic plate having a predetermined outer shape, said dielectric slab has an outer shape corresponding to the outer shape of said ground plane, and said dielectric layer has an outer shape corresponding to the outer shape of said dielectric slab.

2. An antenna according to claim 1, wherein said dielectric layer includes a gas layer including air or a vacuum layer.

3. An antenna according to claim 1, wherein each of said perturbations is formed from a metallic strip or slot provided perpendicular to the transmission direction.

4. An antenna according to claim 1, wherein each of said perturbations is formed from a metallic strip or slot having an angle of 45° with respect to the transmission direction.

5. An antenna according to claim 1, wherein said plurality of perturbations include a pair of metallic strips or pair of slots which form an angle of 90° with each other, and which are loaded on said dielectric slab so as to form an angle of 45° with respect to the transmission direction.

6. An antenna according to claim 1, wherein said plurality of perturbations include a pair of perturbations parallel-arranged at an interval of approximately ¼ of a wavelength of the electromagnetic wave in the transmission direction.

7. An antenna according to claim 6, wherein one of said pair of perturbations is formed on one surface of said dielectric slab, and the other is formed on an opposite surface of said dielectric slab.

8. An antenna according to claim 6, wherein said pair of perturbations are formed on an upper surface of said dielectric slab.

9. An antenna according to claim 1, wherein:

said feed is formed to radiate a cylindrical wave, and a wave-front conversion section is arranged at a first end of said dielectric slab for converting the cylindrical wave radiated by said feed into a plane wave and guiding the plane wave to the transmission guide.

10. An antenna according to claim 9, wherein said wave-front conversion section is formed by extending said dielectric slab toward said feed.

11. An antenna according to claim 10, wherein a matching section for matching said feed and said wave-front conversion section and guiding the electromagnetic wave supplied by said feed to said wave-front conversion section is arranged at a distal end of said wave-front conversion section.

12. An antenna according to claim 11, wherein said matching section is tapered to decrease in thickness toward an electromagnetic wave input side.

13. An antenna according to claim 11, wherein said matching section is formed from a dielectric having a permittivity different from a permittivity of said dielectric slab.

14. An antenna according to claim 10, wherein:

said feed is formed to transmit an electromagnetic wave input at a first end of said feed to the first end of said dielectric slab along said ground plane and to radiate the electromagnetic wave from an aperture at a second end of said feed that is formed to surround an edge of the first end of said dielectric slab, and a matching section, projecting toward said ground plane so as to decrease a gap between said feed and a surface of said wave-front conversion section stepwise or continuously toward said wave-front conversion section in order to match said feed and said wave-front conversion section, is arranged in the aperture at the second end of said feed.

15. An antenna according to claim 9, wherein:

said wave-front conversion section has a reflecting wall for converting the cylindrical wave into the plane wave and reflecting the plane wave, and is arranged to make one half of the reflecting wall face the first end of said dielectric slab, and said feed is arranged on a side opposite to said dielectric slab via said ground plane while a radiation surface faces the other half of the reflecting wall of said wave-front conversion section so as to radiate an electromagnetic wave toward the other half.

16. An antenna according to claim 15, wherein a matching section for matching said wave-front conversion section and the transmission guide of said dielectric slab is arranged at the first end of said dielectric slab.

17. An antenna according to claim 16, wherein said matching section is tapered to decrease in thickness toward an electromagnetic wave input side.

18. An antenna according to claim 16, wherein said matching section is formed from a dielectric having a permittivity different from a permittivity of said dielectric slab.

19. An antenna according to claim 15, wherein:

said wave-front conversion section is formed to transmit an electromagnetic wave reflected by the reflecting wall to the first end of said dielectric slab along said ground plane and to radiate the electromagnetic wave from an aperture at a second end of said feed that is formed to surround an edge of the first end of said dielectric slab, and a matching section, projecting toward said ground plane so as to decrease a gap between said feed and a surface of said dielectric slab stepwise or continuously toward said dielectric slab in order to match said wave-front conversion section and the transmission guide of said dielectric slab, is arranged in the aperture at the second end of said wave-front conversion section.

20. An antenna according to claim 9, wherein said feed has a plurality of radiators having different radiation center positions, and said wave-front conversion section converts a cylindrical wave radiated by each radiator into a plane wave whose wave front is inclined at an angle corresponding to the radiation center position of said each radiator, and supplies the plane wave to the transmission guide.

21. A dielectric leaky-wave antenna comprising:

a ground plane;

a dielectric slab arranged on one surface of said ground plane to form a transmission guide for transmitting an electromagnetic wave along a surface from one end to the other end between said dielectric slab and said ground plane;

a plurality of perturbations loaded across said dielectric slab with respect to a transmission direction of the electromagnetic wave for leaking the electromagnetic wave from said dielectric slab;

a feed for supplying the electromagnetic wave across an entire width of the transmission guide formed by said ground plane and said dielectric slab; and a dielectric layer which is interposed between said ground plane and said dielectric slab and has a lower permittivity than a permittivity of said dielectric slab.

* * * * *